US010066465B2

(12) United States Patent
Portman

(10) Patent No.: US 10,066,465 B2
(45) Date of Patent: Sep. 4, 2018

(54) CHEMICAL INJECTION WITH SUBSEA PRODUCTION FLOW BOOST PUMP

(71) Applicant: Baker Hughes, a GE Company, LLC, Houston, TX (US)

(72) Inventor: Lance Portman, The Woodlands, TX (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 0 days.

(21) Appl. No.: 15/719,100

(22) Filed: Sep. 28, 2017

(65) Prior Publication Data

US 2018/0106135 A1 Apr. 19, 2018
US 2018/0223635 A9 Aug. 9, 2018

Related U.S. Application Data

(60) Provisional application No. 62/406,496, filed on Oct. 11, 2016.

(51) Int. Cl.

| | |
|---|---|
| ***E21B 33/076*** | (2006.01) |
| ***E21B 34/04*** | (2006.01) |
| ***E21B 43/01*** | (2006.01) |
| ***E21B 43/12*** | (2006.01) |
| ***E21B 43/16*** | (2006.01) |

(Continued)

(52) U.S. Cl.

CPC ..... *E21B 43/01* (2013.01); *E21B 33/076* (2013.01); *E21B 34/04* (2013.01); *E21B 43/116* (2013.01); *E21B 43/121* (2013.01); *E21B 43/36* (2013.01)

(58) Field of Classification Search

CPC ..... E21B 33/076; E21B 34/04; E21B 43/01; E21B 43/121; E21B 43/16; E21B 43/36

See application file for complete search history.

(56) References Cited

U.S. PATENT DOCUMENTS 5,547,021 A 8/1996 Raden
7,059,345 B2 * 6/2006 Shaw ..... G05D 16/208 137/565.35

(Continued)

FOREIGN PATENT DOCUMENTS

WO WO-2005040670 A1 * 5/2005 ..... E21B 43/01
WO 2016-043877 A1 3/2016

OTHER PUBLICATIONS

International Search Report and Written Opinion dated Jan. 5, 2018 for corresponding PCT/US2017/054074.

*Primary Examiner* — Matthew R Buck

(74) *Attorney, Agent, or Firm* — Bracewell LLP; James E. Bradley

(57) ABSTRACT

A subsea well production system includes a subsea boost pump coupled with a subsea tree conduit having a valve in the subsea tree conduit. A boost pump outlet conduit connects between a discharge of the boost pump and an outlet flow line. A recirculation line extends from the boost pump outlet conduit to the subsea tree conduit. A chemical injection line having a chemical source valve extends from a chemical injection source and is connected to the subsea tree conduit at a point between the valve in the subsea tree conduit and the intake of the boost pump. During production flow boosting, the boost pump pumps well fluid. During chemical injection, the boost pump pumps chemicals into the subsea tree.

20 Claims, 2 Drawing Sheets

(51) Int. Cl.
*E21B 43/36* (2006.01)
*E21B 43/116* (2006.01)

(56) References Cited

U.S. PATENT DOCUMENTS

| | | | | |
|---|---|---|---|---|
| 7,163,063 | B2 * | 1/2007 | Seams | E21B 43/006 166/309 |
| 7,275,599 | B2 * | 10/2007 | Wilde | E21B 43/12 166/372 |
| 7,565,932 | B2 * | 7/2009 | Lawson | F04B 47/06 166/105 |
| 7,654,319 | B2 * | 2/2010 | Chitty | E21B 21/063 166/250.01 |
| 9,528,350 | B2 * | 12/2016 | Lunde | C02F 1/686 |
| 9,920,597 | B2 * | 3/2018 | Homstvedt | E21B 43/01 |
| 2003/0159581 | A1 * | 8/2003 | Sanderford | E21B 43/34 95/243 |
| 2003/0217956 | A1 | 11/2003 | Mohsen et al. | |
| 2006/0096760 | A1 | 5/2006 | Ohmer | |
| 2007/0131429 | A1 * | 6/2007 | Brammer | E21B 43/40 166/357 |
| 2007/0274842 | A1 * | 11/2007 | Campen | E21B 43/36 417/53 |
| 2009/0008101 | A1 * | 1/2009 | Coady | E21B 43/121 166/370 |
| 2009/0151953 | A1 | 6/2009 | Brown et al. | |
| 2011/0168413 | A1 * | 7/2011 | Bachtell | E21B 43/122 166/401 |
| 2014/0112803 | A1 * | 4/2014 | Hallset | E21B 41/0007 417/53 |

* cited by examiner

CHEMICAL INJECTION WITH SUBSEA PRODUCTION FLOW BOOST PUMP

CROSS REFERENCE TO RELATED APPLICATION

This application claims priority to provisional application Ser. No. 62/406,496, filed Oct. 11, 2016.

FIELD OF INVENTION

The present disclosure relates to boosting the flow of well fluids from a subsea well using a sea floor boost pump, and in particular to using the sea floor boost pump to also selectively inject chemicals into the well.

BACKGROUND

Subsea boost pumps have been proposed to boost production from subsea wells. The subsea boost pump increases the drawdown on the well, boosting the pressure of the produced fluids to overcome pipeline and hydrostatic losses. One type of subsea boost pump proposed comprises an electrical submersible pump mounted in a canister or flow line jumper.

It is also known to inject chemicals into wells to enhance production. Normally, a chemical injection pump injects the chemicals. The chemical injection pump is separate from the well fluid pump employed to pump well fluid from the well.

In many wells, the well fluid being produced contains both liquid and gas hydrocarbons. The performance of certain types of well pumps, particularly centrifugal pumps, is detrimentally affected by a high gas content in the well fluids. Various types of separators may be employed to separate the oil from the gas prior to reaching the intake of the well pump. After the discharge of the pump, the liquid enriched phase may be recirculated to the pump intake to reduce the relative gas content at the pump intake.

SUMMARY

A subsea well production system comprises a subsea boost pump having an intake operatively coupled to a subsea tree conduit of a subsea tree. A valve in the subsea tree conduit in the subsea tree conduit selectively opens and closes the subsea tree conduit. A boost pump outlet conduit operatively couples between a discharge of the boost pump and an outlet flow line. A recirculation line extends from the boost pump outlet conduit to the subsea tree conduit. A chemical injection source line extends from a chemical injection source and is connected to the subsea tree conduit at a point between the valve in the subsea tree conduit and the intake of the boost pump. A chemical source valve selectively opens and closes the chemical injection source line. While the system is in a production flow boosting mode, the valve in the subsea tree conduit is open and the chemical source valve is closed, causing the boost pump to pump well fluid flowing from the subsea tree to the outlet flow line, and in many cases diverting a portion of the well fluid back through the recirculation line to the subsea tree conduit. While the system is in a chemical injection mode, the valve in the subsea tree conduit is closed and the chemical source valve is open, causing the boost pump to pump the chemical from the chemical source through the recirculation line into the subsea tree conduit and from the subsea tree conduit into the subsea tree.

An intake fluid conditioner may be mounted in the subsea tree conduit. The intake fluid conditioner has means for separating heavier and lighter components in the well fluid flowing from the subsea tree and forming a storage reservoir of liquid while the system is in the production flow boosting mode. The recirculation line extends from the boost pump outlet fluid conditioner to the intake fluid conditioner. While the system is in the production flow boosting mode, the recirculation line delivers a liquid-rich portion of the well fluid discharged by the boost pump to the intake fluid conditioner to mix with the well fluid flowing from the subsea tree. While the system is in the chemical injection mode, the recirculation line delivers the chemical discharged by the boost pump to the intake fluid conditioner and from there to the subsea tree.

An outlet fluid conditioner may be mounted in the boost pump outlet conduit. The outlet fluid conditioner has means for separating gas and liquid components of well fluid discharged from the boost pump and delivering the heavier components to the outlet recirculation line while the system is in the production flow boosting mode. The recirculation line extends from the outlet fluid conditioner to the subsea tree conduit or intake fluid conditioner. While the system is in the production flow boosting mode, the recirculation line delivers a liquid-rich portion of the well fluid within the outlet fluid conditioner to the subsea tree conduit or intake fluid conditioner to mixx with the well fluid flowing from the subsea tree. While the system is in the chemical injection mode, the recirculation line delivers the chemical in the outlet fluid conditioner to the subsea tree conduit and from there into the subsea tree.

The intake fluid conditioner in the embodiment shown separates a higher liquid content portion of the well fluid flowing from the subsea tree from a lower liquid content portion to create a liquid level in the intake fluid conditioner. The recirculation line extends to the intake fluid conditioner at a point selected to be above the liquid level in the intake fluid conditioner. The intake fluid conditioner has an outlet in the subsea tree conduit that is selected to be below the liquid level in the intake fluid conditioner. The valve in the subsea tree conduit is between the outlet of the intake fluid conditioner and the intake of the boost pump.

In the embodiment shown, the outlet fluid conditioner separates a higher liquid content portion of the well fluid from a lower liquid content portion to create a liquid level in the outlet fluid conditioner. The recirculation line is connected to the outlet fluid conditioner at a point selected to be below the liquid level in the outlet fluid conditioner. The outlet flow line is adapted to be connected to the outlet fluid conditioner below the liquid level in the outlet fluid conditioner.

The chemical source may comprise a chemical tank adapted to be located subsea adjacent the boost pump, or a conduit to a remotely located chemical tank, either subsea or on the surface. The boost pump may comprise a canister containing an electrical submersible pump.

Figure 1:
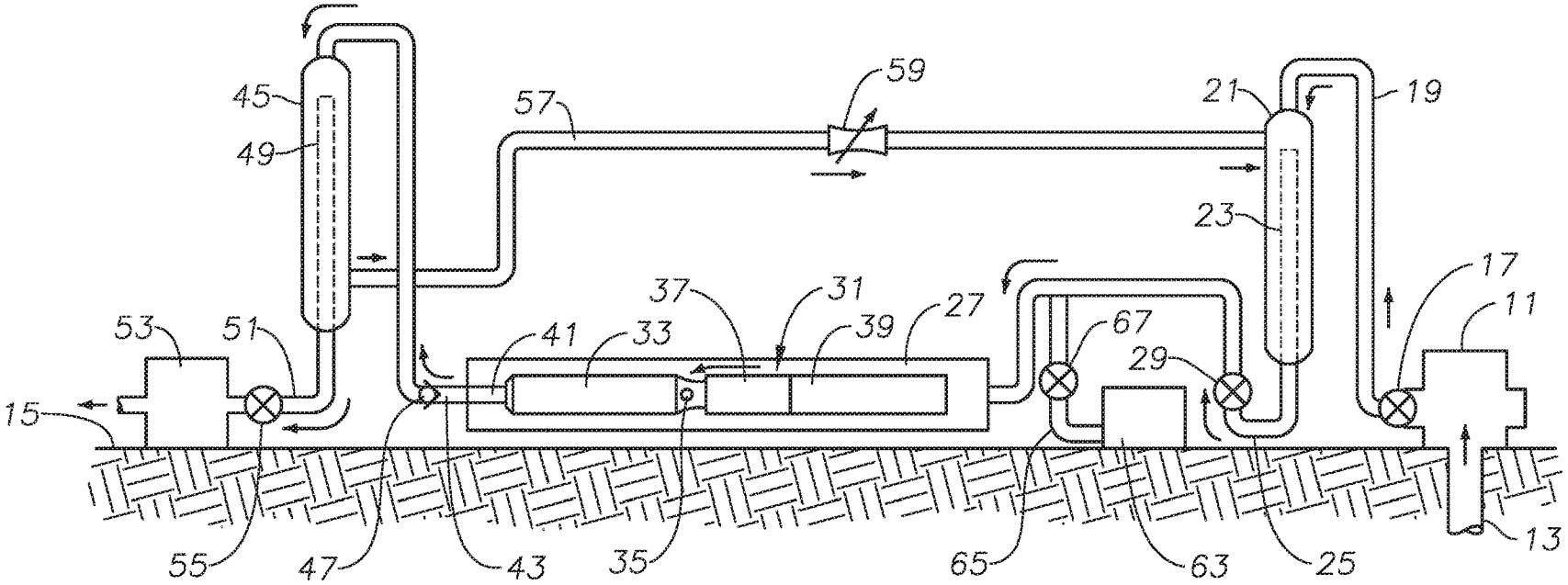
FIG. 1 is a schematic view of subsea boost pump system in a production mode with arrows indicating well fluid production flow.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 shows a sea floor pressure boosting system operatively connected to subsea well production equipment such as a subsea tree 11. Subsea tree 11 is a conventional pressure control tubular member that is mounted above a well 13. Subsea tree 11 is located on or near a sea floor 15. Subsea tree 11 typically has a number of valves, including a production flow or wing valve 17. A subsea tree flow line 19 extends from wing valve 17 to convey well fluid flowing from well 13.

In this example, subsea tree flow line 19 connects to an intake fluid conditioner 21, which is a vessel configured to create a level of liquid therein. Intake conditioner 21 has internal components to separate lighter or gaseous components from the heavier or liquid components, such as oil and water. In this example, intake conditioner 21 has an internal, vertically oriented perforated tube 23 extending upward from its outlet, which is on a lower end. Well fluid flows into the upper end of intake conditioner 21 and swirls as it moves downward. The swirling tends to cause the heavier components to move into an annulus outside of perforated tube 23 and the lighter components to remain within perforated tube 23. The holes in perforated tube 23 meter the liquid outside of perforated tube 23 into perforated tube 23 at a selected flow rate.

The heavier components within perforated tube 23 flow out of intake fluid conditioner 21 into a pump intake line 25 that extends from a lower end of intake conditioner 21. Heavier component well fluid accumulates in the annulus outside of perforated tube 23 to a liquid level that varies depending on the quantity of gas within the well fluid. If gas slugs flow from well 13, the liquid level may drop, but the perforations in perforated tube 23 continue to supply some liquid to pump intake line 25. The lighter components are not vented to the exterior of intake fluid conditioner 21, rather will mix with the heavier components in perforated tube 23 and flow to pump intake line 25. Pump intake line 25, intake conditioner 21, and subsea tree flow line 19 may be considered to comprise a subsea tree conduit leading from subsea tree 11.

Pump intake line 25 leads to a sea floor boost pump assembly that may be a variety of types, such as a centrifugal pump, a multi-phase pump or a twin-screw pump, for example. In this embodiment, the pump assembly includes a flow line jumper, conduit or canister 27. Pump intake line 25 has a pump intake valve 29, which may be considered to be a subsea tree conduit valve that selectively opens and closes the outlet of intake fluid conditioner 21. Pump canister 27 is a conduit or canister, normally oriented horizontal, that has an electrical submersible pump (ESP) 31 mounted inside. ESP 31 includes a centrifugal pump 33 that has a large number of stages, each stage comprising an impeller and a diffuser. Pump 33 has an intake 35 for receiving fluid flowing within pump canister 27. A pressure equalizer or seal section 37 secures to intake 35 of pump 33. A motor 39 connects to seal section 37. Motor 39 is normally a three-phase electrical motor filled with a dielectric lubricant to lubricate internal bearings. Seal section 37 has a movable element, such as a bladder or bellows, that equalizes a pressure of the lubricant in motor 39 with well fluid on the exterior of motor 39 in pump canister 27. The well fluid flowing from pump intake line 25 flows around motor 39 into pump intake 35.

Pump 33 has a discharge 41 that extends sealingly out of pump canister 27 and connects to an outlet flow line 43. A check valve 47 in outlet flow line 43 prevents back flow into pump 33. In this embodiment, outlet flow line 43 extends to an outlet fluid conditioner 45, which is a vessel similar to intake conditioner 21. Outlet conditioner 45 has features to separate lighter gaseous components from the heavier liquid components, such as oil and water. In this example, outlet conditioner 45 has an internal, vertically oriented perforated tube 49 extending upward from its outlet, which is on a lower end. Well fluid from pump 33 flows into the upper end of outlet conditioner 45 and swirls as it moves downward. The swirling tends to cause the heavier components to move into the annulus on the outside of perforated tube 49 and the lighter components to remain within perforated tube 49. The holes in perforated tube 49 restrict but allow a selected flow rate of the liquid outside of perforated tube 49 to flow into perforated tube 49.

The heavier components mix with lighter components within perforated tube 49 and flow out an outlet flow line 51 extending from a lower end of outlet conditioner 45. Lighter components are not vented from outlet fluid conditioner 45, rather mix and flow with the heavier components out outlet flow line 51.

Outlet flow line 51 may lead to a production platform on the surface or other equipment on sea floor 15, such as a manifold 53. An outlet valve 55 in outlet flow line 51 selectively opens and closes outlet flow line 51. The holes in perforated tube 49 create a liquid level in the annulus surrounding perforated tube 49. The level of the liquid varies depending on the quantity of gas in the well fluid and the well flow rates.

A diverter or recirculation line 57 extends from outlet conditioner 45 at a point below the liquid level to deliver some of the heavier components of well fluid back to intake conditioner 21. Recirculation line 57 is in fluid communication with subsea tree conduit 19 and enters intake conditioner 21 near or at its upper end, preferably above the liquid level in intake conditioner 21. Recirculation line 57 optionally could be connected directly into subsea tree conduit 19 between wing valve 17 and intake fluid conditioner 21. The recirculated well fluid mixes with the well fluid flowing into intake conditioner 21 from subsea tree flow line 19. A choke 59 is incorporated into recirculation line 57 to meter the flow rate of fluid flowing from outlet conditioner 45. Choke 59 may be adjustable in a variety of manners.

A chemical source selectively supplies chemicals to pump 33 for injection into well 13 while pump 33 is not pumping well fluid. In this embodiment, the chemical source comprises at least one chemical tank 63 that is lowered from a surface production platform to a location near the subsea well fluid boosting system. Chemical tank 63 contains a treating chemical for treating the well fluid within well 13 to improve the flow rate. The treating chemical may be a variety of chemicals depending on the well, such as relatively high pH acid chemicals. Chemical tank 63 preferably has an accumulator or pressure equalizer that equalizes the pressure of the chemicals it contains with the hydrostatic pressure of the sea water.

The chemicals in chemical tank 63 may be dispensed into chemical tank 63 while chemical tank 63 is on the production platform and prior to deploying chemical tank 63 subsea. Alternately, a fill up line (not shown) may extend from the production platform to chemical tank 63 to refill chemical tank 63 after it has been depleted. Alternately, chemical tank 63 could be eliminated and replaced with a special purpose line (not shown) that extends down from the production platform and connects to pump canister 27 to deliver chemicals when needed. The size of chemical tank 63 may vary, and as an example, it could have a capacity of between about 10 and 100 barrels.

A chemical line 65 delivers chemicals from chemical tank 63 to pump canister 27. In this example, chemical line 65 connects into pump intake line 25 at a point between pump intake valve 29 and pump canister 27. Alternately, chemical line 65 could connect directly to pump canister 27. A chemical line valve 67 selectively opens and closes chemical line 65.

While in the production flow mode of FIG. 1, chemical line valve 67 is closed and the other valves open. As indicated by the arrows in FIG. 1, well fluid 13 will normally have enough natural pressure to flow from well 13 out subsea tree 11 into intake conditioner 21. Alternately, a down hole pump (not shown) could be suspended within well 13 to convey the well fluid to subsea tree 11. Intake conditioner 21 separates the gaseous portion from the liquid portion, as explained above, to create a level of liquid within intake conditioner 21. The liquid level reduces the chances for large volume gas slugs to flow to pump intake 35, which can cause gas locking of pump 33. All of the well fluid flowing into intake conditioner 21, including all of the gas and liquid, will eventually flow through pump intake line 25 to pump canister 27 and pump intake 35.

Pump 33 boosts the pressure of the well fluid and delivers it to outlet conditioner 45. Outlet conditioner 45 also creates a liquid level, and returns a portion of the heavier components of the well fluid through recirculation line 57 to intake conditioner 21. The heavier components within recirculation line 57 mix with the well fluid flowing into intake conditioner 21 from subsea tree flow line 19. The mixture of heavier and lighter components in perforated tube 49 of outlet conditioner 45 flows out outlet flow line 51.

Figure 2:
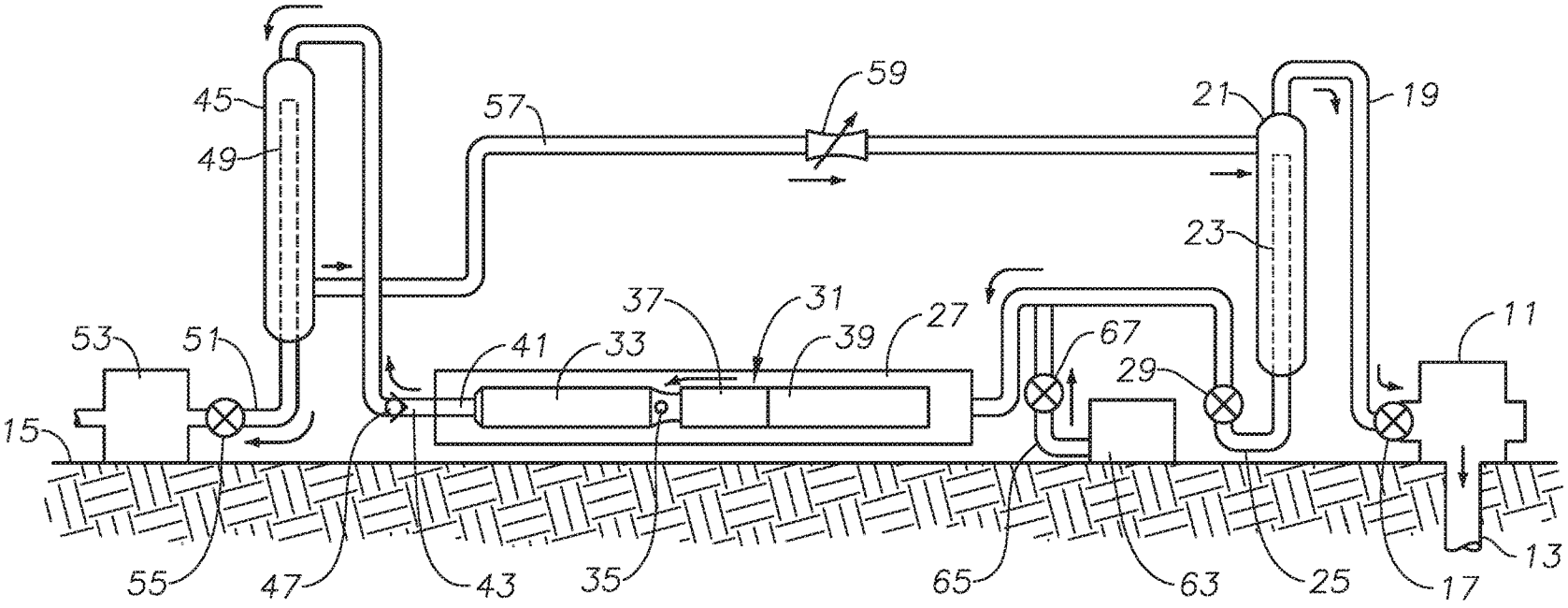
FIG. 2 is a schematic view of the subsea boost pump system of FIG. 1 in a chemical injection mode with arrows indicating chemical injection into the well.

To inject chemicals, the operator closes pump intake valve 29 and outlet line valve 55 and opens chemical line valve 67. Wing valve 17 remains open. Power supplied to pump motor 39 causes the suction of pump 33 to draw chemicals from chemical tank 63 into pump canister 27. Pump 33 pumps the chemicals out outlet flow line 43, causing the chemicals to flow through outlet conditioner 45 and recirculation line 57 into subsea tree conduit 19 as indicated by the arrows in FIG. 2. If the end of recirculation line 57 is connected to the upper end of intake conditioner 21, as schematically shown, the chemicals would enter the upper end of intake conditioner 21, then flow out of intake conditioner 21 into subsea tree conduit 19. Because of the closed pump intake valve 29, the chemicals flow through subsea tree flow line 19 into subsea tree 11 and down well 13. Pump 33 will be pumping the chemicals at a greater pressure than the natural pressure of the well fluid at subsea tree 11. The chemicals are thus bullheaded down well 13 from subsea tree 11.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. A subsea well production system, comprising:

a subsea boost pump;

a subsea tree conduit adapted to be operatively coupled between a subsea tree and an intake of the boost pump to deliver well fluid flowing from the subsea tree to the boost pump;

a valve in the subsea tree conduit that selectively opens and closes the subsea tree conduit;

a boost pump outlet conduit adapted to be operatively coupled between a discharge of the boost pump and an outlet flow line;

a recirculation line extending from the boost pump outlet conduit to the subsea tree conduit;

a chemical injection source of a well fluid treatment chemical;

a chemical injection source line extending from the chemical injection source and connected to the subsea tree conduit at a point between the subsea tree conduit valve and the intake of the boost pump;

a chemical source valve that selectively opens and closes the chemical injection source line; wherein while the system is in a production flow boosting mode, the valve in the subsea tree conduit is open and the chemical source valve is closed, causing the boost pump to pump well fluid flowing from the subsea tree to the outlet flow line; and while the system is in a chemical injection mode, the valve in the subsea tree conduit is closed and the chemical source valve is open, causing the boost pump to pump the chemical from the chemical source through the recirculation line into the subsea tree conduit and from the subsea tree conduit into the subsea tree.

2. The system according to claim 1, further comprising:

an intake fluid conditioner mounted in the subsea tree conduit, the intake fluid conditioner having means for separating heavier and lighter components in the well fluid flowing from the subsea tree and delivering the heavier components to the intake of the boost pump while the system is in the production flow boosting mode; wherein the recirculation line extends from the boost pump outlet conduit;

while the system is in the production flow boosting mode, the recirculation line delivers a portion of the well fluid discharged by the boost pump to the intake fluid conditioner to mix with the well fluid flowing from the subsea tree; and while the system is in the chemical injection mode, the recirculation line delivers the chemical discharged by the boost pump to the subsea tree conduit and from there to the subsea tree.

3. The system according to claim 1, further comprising:

an outlet fluid conditioner mounted in the boost pump outlet conduit, the outlet fluid conditioner having means for separating heavier and lighter components of well fluid discharged from the boost pump and delivering the heavier components to the outlet flow line while the system is in the production flow boosting mode; wherein the recirculation line extends from the outlet fluid conditioner;

while the system is in the production flow boosting mode, the recirculation line delivers a portion of the well fluid within the outlet fluid conditioner to the subsea tree conduit to mix with the well fluid flowing from the subsea tree; and while the system is in the chemical injection mode, the recirculation line delivers the chemical in the outlet fluid conditioner to the subsea tree conduit and from there into the subsea tree.

4. The system according to claim 1, further comprising:

an intake fluid conditioner mounted in the subsea tree conduit, the intake fluid conditioner having means for separating heavier and lighter components of well fluid flowing from the subsea tree and delivering the heavier components from an outlet of the intake fluid conditioner through the valve in the subsea tree conduit to the intake of the boost pump while the system is in the production flow boosting mode;

an outlet conduit valve in the boost pump outlet conduit;

an outlet fluid conditioner mounted in the boost pump outlet conduit, the outlet fluid conditioner having means for separating heavier and lighter components of well fluid discharged by the boost pump and delivering the heavier components from an outlet of the outlet fluid conditioner through the outlet conduit valve the to the outlet flow line while in the production flow boosting mode; wherein the recirculation line extends from the outlet fluid conditioner;

while in the production flow boosting mode, the recirculation line delivers a portion of the well fluid in the outlet fluid conditioner to the intake fluid conditioner to mix with the well fluid flowing from the subsea tree; and while in the chemical injection mode, the outlet conduit valve is closed, the boost pump discharges the chemical into the outlet fluid conditioner, and the recirculation line delivers the chemical within the outlet flow conditioner to the subsea tree conduit and from there to the subsea tree.

5. The system according to claim 1, further comprising:

an intake fluid conditioner in the subsea tree conduit that separates a higher liquid content portion of the well fluid flowing from the subsea tree from a lower liquid content portion to create a liquid level in the intake fluid conditioner; wherein the recirculation line extends from the boost pump outlet conduit to the intake fluid conditioner at a point selected to be above the liquid level in the intake fluid conditioner;

the intake fluid conditioner has an outlet in the subsea tree conduit that is selected to be below the liquid level in the intake fluid conditioner; and the valve in the subsea tree conduit is between the outlet of the intake fluid conditioner and the intake of the boost pump.

6. The system according to claim 1, further comprising:

an outlet fluid conditioner in the boost pump outlet conduit that separates a higher liquid content portion of the well fluid from a lower liquid content portion to create a liquid level in the outlet fluid conditioner;

wherein the recirculation line is connected to the outlet fluid conditioner at a point selected to be below the liquid level in the outlet fluid conditioner; and the outlet flow line is adapted to be connected to the outlet fluid conditioner below the liquid level in the outlet fluid conditioner.

7. The system according to claim 1, further comprising:

an intake fluid conditioner in the subsea tree conduit that separates a higher liquid content portion of the well fluid flowing from the subsea tree from a lower liquid content portion to create a liquid level in the intake fluid conditioner, the intake fluid conditioner having an outlet into the subsea tree conduit that is selected to be at a point below the liquid level in the intake fluid conditioner;

the valve in the subsea tree conduit being located between the outlet of the intake fluid conditioner and the intake of the boost pump;

an outlet fluid conditioner in the boost pump outlet conduit that separates a higher liquid content portion of the well fluid from a lower liquid content portion to create a liquid level in the outlet fluid conditioner; wherein the outlet flow line is adapted to be connected to the outlet fluid conditioner at a point selected to be below the liquid level in the outlet fluid conditioner; and the recirculation line extends from a point selected to be below the liquid level in the outlet fluid conditioner to the intake fluid conditioner at a point selected to be above the liquid level in the intake fluid conditioner.

8. The system according to claim 1, wherein the chemical source comprises a chemical tank adapted to be located subsea adjacent the boost pump.

9. The system according to claim 1, wherein the boost pump comprises:

a canister;

an electrical submersible pump located in the canister; and wherein the subsea tree conduit is connected to the canister.

10. A subsea well production system, comprising:

a subsea boost pump;

a subsea tree conduit;

an intake fluid conditioner in fluid communication with the subsea tree conduit to receive well fluid from a subsea tree while the system is in a production flow boosting mode, the intake fluid conditioner having an internal component that separates heavier and lighter components of the well fluid flowing from the subsea tree, the intake fluid conditioner having a heavier component flow outlet that leads to an intake of the boost pump;

a valve in the subsea tree conduit that selectively opens and closes the subsea tree conduit between the heavier component flow outlet of the intake fluid conditioner and the intake of the boost pump;

an outlet fluid conditioner that receives well fluid discharged by the boost pump and an internal component that separates heavier and lighter components of the well fluid discharged by the boost pump, the outlet fluid conditioner having a heavier component flow outlet for flowing the well fluid from the outlet fluid conditioner into an outlet flow line;

an outlet flow line valve that selectively opens and closes the heavier component flow outlet of the outlet fluid conditioner;

a recirculation line extending from the outlet fluid conditioner and in fluid communication with the subsea tree conduit;

a chemical injection source of a well fluid treatment chemical;

a chemical injection source line extending from the chemical injection source and connected to the subsea tree conduit at a point between the valve in the subsea tree conduit and the intake of the boost pump;

a chemical source valve that selectively opens and closes the chemical injection source line; wherein while the system is in a production flow boosting mode, the valve in the subsea tree conduit and the outlet flow line valve are open and the chemical source valve is closed, causing the boost pump to pump well fluid flowing from the subsea tree into the outlet flow line, and diverting a portion of the well fluid back through the recirculation line to the intake fluid conditioner; and while the system is in a chemical injection mode, the valve in the subsea tree conduit and the outlet flow line valve are closed and the chemical source valve is open, causing the boost pump to pump the chemical from the chemical source through the recirculation line into subsea tree conduit and into the subsea tree.

11. The system according to claim 10, wherein each of the intake fluid conditioner and the outlet fluid conditioner comprises:

a vessel; wherein the internal component in the intake fluid conditioner creates a liquid level in the vessel of the intake fluid conditioner;

the internal component in the outlet fluid conditioner creates a liquid level in the vessel of the outlet fluid conditioner;

the heavier component flow outlets of the intake fluid conditioner and the outlet fluid conditioner are selected to be below the liquid levels in the intake fluid conditioner and the outlet fluid conditioner; and one end of the recirculation line connects to the vessel of the outlet fluid conditioner at a place selected to be below the liquid level in the outlet fluid conditioner.

12. The system according to claim 11, wherein:

another end of the recirculation line connects to the vessel of the intake fluid conditioner at a place selected to be above the liquid level in the intake fluid conditioner.

13. The system according to claim 10, wherein the boost pump comprises:

a canister in fluid communication with the outlet of the intake fluid conditioner; and an electrical submersible pump located in the canister.

14. The system according to claim 10, wherein the chemical source comprises a chemical tank adapted to be located subsea adjacent the boost pump.

15. The system according to claim 10, further comprising:

a choke in the recirculation line for varying a flow rate through the recirculation line.

16. A well fluid production method, comprising:

providing a subsea system having a subsea boost pump, a subsea tree conduit connected between a subsea tree and an intake of the boost pump, a boost pump outlet conduit between a discharge of the boost pump and an outlet flow line, a recirculation line between the boost pump outlet conduit and the subsea tree conduit, a chemical injection source of a well fluid treatment chemical, and a chemical injection source line extending from the chemical injection source and the intake of the boost pump;

while in a production flow boosting mode, flowing well fluid from the subsea tree conduit to the boost pump intake, and with the boost pump, pumping the well fluid into the outlet flow line; and while in a chemical injection mode, blocking well fluid flow from the subsea tree conduit to the intake of the boost pump and flowing the chemical from the chemical source to the intake of the boost pump, then pumping the chemical through the recirculation line into the subsea tree conduit and from the subsea tree conduit into the subsea tree.

17. The method according to claim 16, further comprising:

providing the system with an intake fluid conditioner in the subsea tree conduit, wherein the recirculation line extends from the boost pump outlet conduit to the intake fluid conditioner;

while in the production flow boosting mode, with the intake fluid conditioner, separating heavier and lighter components in the well fluid flowing from the subsea tree and delivering the heavier components to the intake of the boost pump, then delivering a portion of the well fluid discharged by the boost pump through the recirculation line to the intake fluid conditioner to mix with the well fluid flowing from the subsea tree; and while the system is in the chemical injection mode, delivering the chemical discharged by the boost pump to the intake fluid conditioner and from there to the subsea tree.

18. The system according to claim 16, further comprising:

providing the system with an outlet fluid conditioner in the boost pump outlet conduit, wherein the recirculation line extends from the outlet fluid conditioner to the subsea tree conduit;

while in the production flow boosting mode, with the outlet fluid conditioner, separating heavier and lighter components of well fluid discharged from the boost pump and delivering the heavier components to the outlet flow line, and delivering a portion of the heavier components through the recirculation line to the subsea tree conduit; and while the system is in the chemical injection mode, delivering the chemical discharged from the boost pump to the outlet fluid conditioner, and from the outlet fluid conditioner through the recirculation line to the subsea tree conduit and from there into the subsea tree.

19. The method according to claim 16, further comprising:

providing the system with an intake fluid conditioner in the subsea tree conduit and an outlet fluid conditioner in the boost pump outlet conduit, wherein the recirculation line extends from the outlet fluid conditioner to the intake fluid conditioner;

while in the production flow boosting mode:

with the intake fluid conditioner, separating heavier and lighter components of the well fluid flowing from the subsea tree and delivering the heavier components to the intake of the boost pump;

with the boost pump, pumping the heavier components into the outlet fluid conditioner, further separating heavier and lighter components of the well fluid with the outlet fluid conditioner, and flowing the heavier components to the outlet flow line;

flowing a portion of the heavier components in the outlet fluid conditioner through the recirculation line to the intake fluid condition; and while the system is in the chemical injection mode, delivering the chemical discharged by the boost pump to the outlet fluid conditioner and from there to the subsea tree conduit and into the subsea tree.

20. The method according to claim 19, wherein:

separating heavier and lighter components in the well fluid flowing into the intake fluid conditioner comprises creating a liquid level in the intake fluid conditioner, and delivering the heavier components to the intake of the boost pump comprises drawing the heavier components from a point below the liquid level in the intake fluid conditioner;

separating heavier and lighter components in the well fluid flowing into the outlet fluid conditioner comprises creating a liquid level in the outlet fluid conditioner;

flowing the heavier components to the outlet flow line comprises drawing the heavier components from a point below the liquid level in the outlet fluid conditioner; and flowing a portion of the heavier components to the intake fluid conditioner comprises drawing the heavier components from a point below the liquid level in the outlet fluid conditioner.

* * * * *